US011618270B2

(12) United States Patent
Ogasahara

(10) Patent No.: US 11,618,270 B2
(45) Date of Patent: Apr. 4, 2023

(54) INKJET RECORDING APPARATUS

(71) Applicant: KYOCERA Document Solutions Inc., Osaka (JP)

(72) Inventor: Okito Ogasahara, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/584,243

(22) Filed: Jan. 25, 2022

(65) Prior Publication Data

US 2022/0234373 A1 Jul. 28, 2022

(30) Foreign Application Priority Data

Jan. 27, 2021 (JP) ..... JP2021-010905

(51) Int. Cl.

| | |
|---|---|
| ***B41J 13/00*** | (2006.01) |
| ***B41J 2/135*** | (2006.01) |
| ***B41J 13/10*** | (2006.01) |
| ***B41J 3/60*** | (2006.01) |
| ***B65H 5/06*** | (2006.01) |
| ***B65H 5/26*** | (2006.01) |
| ***B65H 7/06*** | (2006.01) |
| ***B65H 7/08*** | (2006.01) |
| *B41J 2/165* | (2006.01) |

(52) U.S. Cl.

CPC ..... *B41J 13/0045* (2013.01); *B41J 2/135* (2013.01); *B41J 3/60* (2013.01); *B41J 13/0018* (2013.01); *B41J 13/0054* (2013.01); *B41J 13/103* (2013.01); *B65H 5/062* (2013.01); *B65H 5/26* (2013.01); *B65H 7/06* (2013.01); *B65H 7/08* (2013.01); *B41J 2/16552* (2013.01); *B65H 2404/632* (2013.01); *B65H 2513/42* (2013.01); *B65H 2513/50* (2013.01); *B65H 2801/06* (2013.01)

(58) Field of Classification Search

CPC . B41J 13/0045; B41J 2/135; B41J 3/60; B41J 13/0018; B41J 13/0054; B41J 13/103; B41J 2/16552; B65H 5/062; B65H 5/26; B65H 7/06; B65H 7/08; B65H 2404/632; B65H 2513/42; B65H 2513/50; B65H 2801/06

See application file for complete search history.

(56) References Cited

U.S. PATENT DOCUMENTS 8,240,660 B2 * 8/2012 Yamamoto ..... B41J 29/023 271/189
2009/0102908 A1 * 4/2009 Imoto ..... B41J 11/0024 347/104

FOREIGN PATENT DOCUMENTS

JP 2006-282349 A 10/2006
JP 2008-214020 A 9/2008

* cited by examiner

*Primary Examiner* — Henok D Legesse
(74) *Attorney, Agent, or Firm* — Stein IP, LLC

(57) ABSTRACT

An inkjet recording apparatus includes, among a plurality of branch conveyance passages, ones with different conveyance distances for a recording medium. Based on the timing of the sensing of the recording medium by a recording medium sensor, a controller controls a switching portion to make it switch the destination of the conveyance of the recording medium to one of the branch conveyance passages.

11 Claims, 10 Drawing Sheets

INKJET RECORDING APPARATUS

INCORPORATION BY REFERENCE

This application is based on and claims the benefit of priority from Japanese Patent Application No. 2021-010905 filed on Jan. 27, 2021, the contents of which are hereby incorporated by reference.

BACKGROUND

The present disclosure relates to an inkjet recording apparatus.

Some known image forming apparatuses are capable of switching paths for the conveyance of a recording medium. For example, for the conveyance of sheets that have images formed on them by ink ejection, a plurality of conveyance paths are provided so that, while the conveyance of a sheet is delayed in one conveyance path, another sheet is fed into another conveyance path. In this way, with a simple construction it is possible to minimize a drop in productivity while preventing the curling and the like of sheets. For another example, between a sheet feeding portion and an image forming portion, a plurality of branch conveyance passages are provided, of which one is selected for use. With this construction, even if trouble in one branch conveyance passage makes it unusable, another conveyance passage can be used. In that way, it is possible to continue the operation of the image forming apparatus as a whole without suspending it, and thereby to avoid a drop in processing capacity.

SUMMARY

According to one aspect of the present disclosure, an inkjet recording apparatus includes: a recording head that has a plurality of nozzles through which ink is ejected; a conveyance belt that conveys a recording medium and that is endless and has along the conveyance direction of the recording medium a plurality of openings through which the ink is passed when the recording head performs flushing in which the ink is ejected from the nozzles with timing different from the timing for image formation; a sheet feeding portion that feeds out the recording medium; a shared conveyance passage through which the recording medium fed out from the sheet feeding portion is conveyed; a plurality of branch conveyance passages that branch off the shared conveyance passage to meet it upstream of the conveyance belt and through which the recording medium conveyed along the shared conveyance passage is fed to the conveyance belt; a switching portion that switches the conveyance destination of the recording medium conveyed along the shared conveyance passage to one of the plurality of branch conveyance passages; a recording medium sensor that senses the recording medium fed out from the sheet feeding portion; and a controller that controls the switching portion. The plurality of branch conveyance passages include branch conveyance passages with different conveyance distances for the recording medium. The controller controls the switching portion to make it switch the conveyance destination of the recording medium to one of the plurality of branch conveyance passages based on the sensing timing of the recording medium by the recording medium sensor.

This and other objects of the present disclosure, and the specific benefits obtained according to the present disclosure, will become apparent from the description of embodiments which follows.

DETAILED DESCRIPTION

Nowadays it is common on inkjet recording apparatuses such as inkjet printers to eject ink out of nozzles regularly to perform flushing (blank ink ejection) with the aim of alleviating or preventing the clogging of the nozzles with dried ink. For example, a type of flushing known as line flushing involves providing openings in a conveyance belt for conveying a recording medium and ejecting ink out of the nozzles in a recording head so as to pass the ink through the openings in the conveyance belt.

To perform such flushing, it is necessary to feed the recording medium onto the conveyance belt in such a way that the recording medium reaches a particular position on the conveyance belt from displaced from (not overlapping) the openings used in flushing with respect to the movement direction of the conveyance belt (the conveyance direction of the recording medium). Accordingly the feeding-out of the recording medium from a sheet feeding portion toward the conveyance belt is usually performed with timing that is earlier, by the conveyance time of the recording medium from the sheet feeding portion to the conveyance belt, than the time point at which the recording medium reaches the particular position on the conveyance belt.

Inconveniently, even when the recording medium is fed out from the sheet feeding portion with prescribed timing, if the recording medium slips on the surface of a roller (e.g., feed roller) in the sheet feeding portion, the recording medium suffers a conveyance delay. In that case, the recording medium reaches the above-mentioned particular position on the conveyance belt with a delay. This may result in the recording medium being placed on the conveyance belt so as to overlap other openings upstream of the above-mentioned particular position. If this happens, it is not possible to make a recording head perform flushing involving ink ejection toward those openings.

The present disclosure presents an inkjet recording apparatus on which, even if a recording medium has a conveyance delay, it is possible to place the recording medium at a predetermined position on the conveyance belt with respect to openings in it (e.g., a position displaced from the openings in the conveyance direction) and to make a recording head perform flushing involving ink ejection through those openings.

Figure 1:
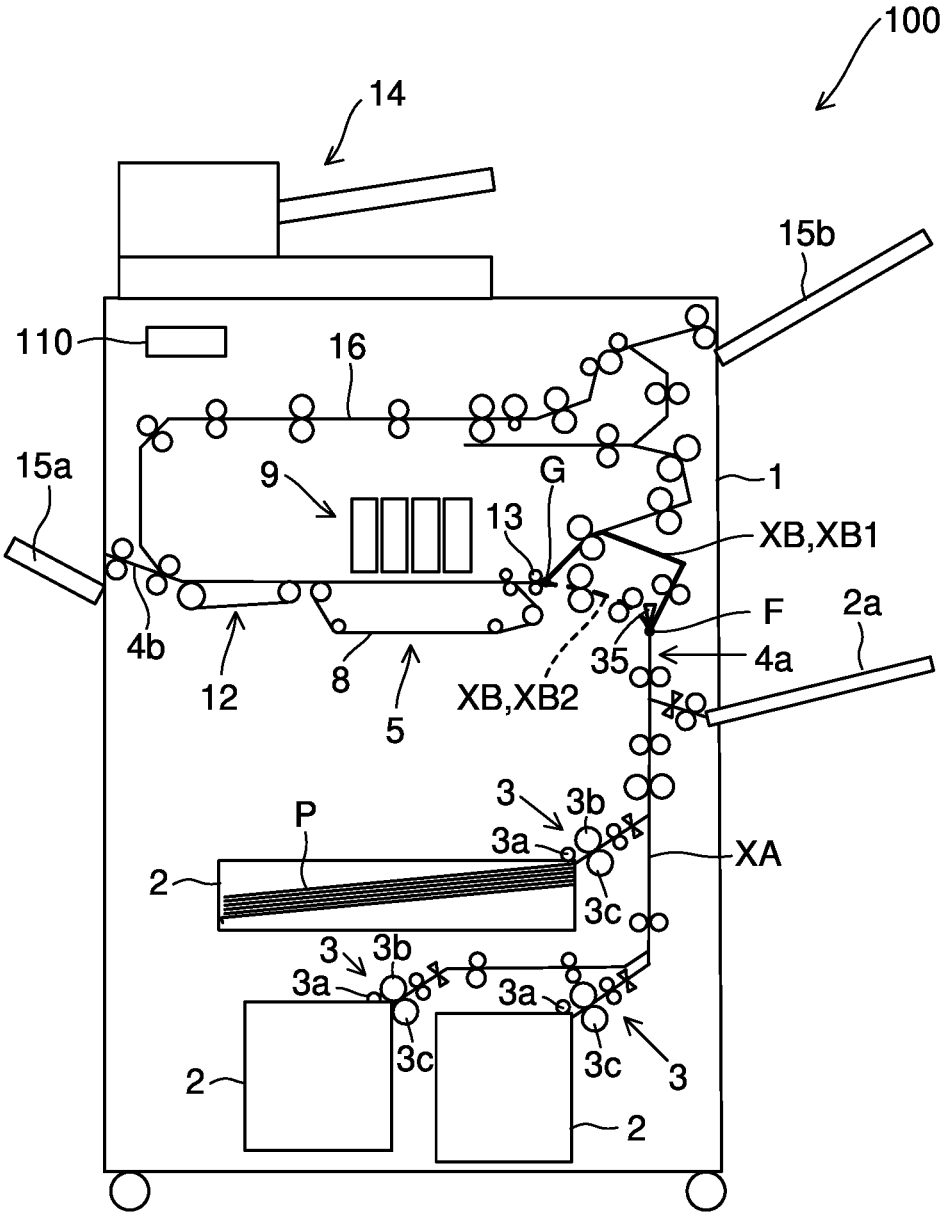
FIG. 1 is an illustrative diagram showing an outline of the construction of a printer as an inkjet recording apparatus according to one embodiment of the present disclosure.

1. Construction of an Inkjet Recording Apparatus: An embodiment of the present disclosure will be described below with reference to the accompanying drawings. FIG. 1 is an illustrative diagram showing an outline of the construction of a printer 100 as an inkjet recording apparatus according to an embodiment of the present disclosure. The printer 100 includes a plurality of sheet feed cassettes 2 as a sheet storage portion. The sheet feed cassettes 2 each store at least one sheet of a recording medium of a different size. The sheet feed cassettes 2 are disposed in a lower part of the printer body 1. The printer 100 may include a single sheet feed cassette 2.

Downstream of each sheet feed cassette 2 in the sheet conveyance direction, that is, at the upper right of each sheet feed cassette 2 in FIG. 1, a sheet feeding portion 3 as a sheet feeding device is provided. Each sheet feeding portion 3 includes a pickup roller 3*a*, a feed roller 3*b*, and a retard roller 3*c*. The pickup roller 3*a* rotates while in contact with the uppermost surface of the sheets P stored in the sheet feed cassette 2. Thus at least one sheet P including the topmost sheet P is fed out of the sheet feed cassette 2.

The feed roller 3*b* is fitted to a rotary shaft (not shown) coupled to a driving motor (driving source; not shown), and rotates under the driving force from the driving motor. Between the pickup roller 3*a* and the feed roller 3*b*, a driving force transmission gear (not shown) is disposed that transmits the rotation of the feed roller 3*b* to the pickup roller 3*a*. The feed roller 3*b* and the retard roller 3*c* are disposed in contact with each other to form a nip.

The feed roller 3*b* and the retard roller 3*c* feed forward the sheets P fed out by the pickup roller 3*a*, one after another while separating them. Specifically, the at least one sheet P fed out by the pickup roller 3*a* enters the nip between the feed roller 3*b* and the retard roller 3*c*. Here the retard roller 3*c* is pivoted via a torque limiter so that the retard roller 3*c* remains at rest until acted on by a predetermined torque and, when acted on by a torque exceeding it, rotates by following the feed roller 3*b*. Accordingly, if a plurality of sheets P are fed out together, while the retard roller 3*c* remains at rest, the feed roller 3*b* and the retard roller 3*c* separate the sheets P. Thus only the topmost one sheet P is fed forward.

The printer 100 includes inside it a first sheet conveyance passage 4*a*. The first sheet conveyance passage 4*a* is disposed at the upper right of each sheet feed cassette 2, that is, in its sheet feeding direction. A sheet P fed out of any of the sheet feed cassettes 2 enters the first sheet conveyance passage 4*a*, and is conveyed vertically upward along a side face of the printer body 1. Also a sheet placed on a hand-feed tray 2*a* is fed into the first sheet conveyance passage 4*a* so as to be conveyed vertically upward inside the printer body 1.

The first sheet conveyance passage 4*a* has a shared conveyance passage XA and a plurality of branch conveyance passages XB. Along the shared conveyance passage XA, sheets P fed from the sheet feeding portion 3 are conveyed in one direction (without being distributed among multiple directions). Along the plurality of branch conveyance passages XB, which are disposed downstream of the shared conveyance passage XA in the conveyance direction, the sheets P conveyed along the shared conveyance passage XA are fed to a first conveyance belt 8 in a first conveyance unit 5. The branch conveyance passages XB are disposed in parallel so as to branch off the shared conveyance passage XA to meet it upstream of the first conveyance belt 8.

The plurality of branch conveyance passages XB include a first branch conveyance passage XB1 and a second branch conveyance passage XB2. The plurality of branch conveyance passages XB have mutually different lengths; that is, the conveyance distances for a sheet P in the plurality of branch conveyance passages XB differ from each other. In the embodiment, the conveyance distance for the sheet P in the second branch conveyance passage XB2 is shorter than the conveyance distance for the sheet P in the first branch conveyance passage XB1. The conveyance destination of the sheet P conveyed along the shared conveyance passage XA is switched by a switching portion 35 to one of the plurality of branch conveyance passages XB (here to either the first or second branch conveyance passage XB1 or XB2).

The switching portion 35 includes, for example, a switch valve that closes one conveyance passage to guide the sheet P into the other conveyance passage and a solenoid or the like that makes the switch valve pivot. The switching of the conveyance destination by the switching portion 35 is controlled by a controller 110 of the printer 100. Normally (i.e., so long as sheets P are conveyed with no conveyance delay as will be described later), the switching portion 35 is controlled so that the sheet P conveyed along the shared conveyance passage XA is fed to the first branch conveyance passage XB1. The plurality of branch conveyance passages XB may include three or more branch conveyance passages with mutually different conveyance distances for the sheet P. Control can then be performed in such a way that the switching portion 35 switches the conveyance destination of the sheet P to one of the three or more branch conveyance passages. In a construction with three or more branch conveyance passages, any two or more branch conveyance passages may have an equal conveyance distance. An example of control in such a construction will be discussed later.

At the downstream end of the first sheet conveyance passage 4*a* in the sheet conveyance direction, a pair of registration rollers 13 is provided. Closely downstream of the pair of registration rollers 13, the first conveyance unit 5 and a recording portion 9 are disposed. The sheet P fed out of the sheet feed cassette 2 by the sheet feeding portion 3 passes along the first sheet conveyance passage 4*a* to reach the pair of registration rollers 13. The pair of registration rollers 13, while correcting the skew of the sheet P, feeds out the sheet P toward the first conveyance unit 5 with timing coordinated with ink ejection by the recording portion 9.

The sheet P fed to the first conveyance unit 5 by the pair of registration rollers 13 is conveyed by the first conveyance belt 8 (described in detail later) to a position opposite the recording portion 9. The recording portion 9 ejects ink onto the sheet P on the first conveyance belt 8, and thereby an image is recorded on the sheet P. Here the ejection of ink by the recording portion 9 is controlled by the controller 110 in the printer 100.

Downstream of the first conveyance unit 5 in the sheet conveyance direction (at the left side in FIG. 1), a second conveyance unit 12 is disposed. The sheet P having the image recorded on it by the recording portion 9 is fed to the second conveyance unit 12. The ink ejected onto the surface of the sheet P is dried while passing through the second conveyance unit 12.

Downstream of the second conveyance unit 12 in the sheet conveyance direction, a second sheet conveyance passage 4*b* is disposed. The sheet P having passed through the second conveyance unit 12 then, if duplex printing is not desired, passes through the second sheet conveyance passage 4*b* to be discharged onto a sheet discharge tray 15*a* provided outside the left side face of the printer 100.

In an upper part of the printer body 1, over the recording portion 9 and the second conveyance unit 12, a reversing conveyance passage 16 for duplex printing is provided. If duplex printing is desired, the sheet P having undergone recording on one side (first side) and having passed through the second conveyance unit 12 is fed to the reversing conveyance passage 16.

The sheet P fed to the reversing conveyance passage 16 then has its conveyance direction switched in preparation for the subsequent recording on the other side (second side) of the sheet P. The sheet P then passes through the pair of registration rollers 13 to be fed, now with the second side up, once again to the first conveyance unit 5. In the first conveyance unit 5, the sheet P is conveyed to the position opposite the recording portion 9, so that an image is recorded on the second side by ink ejection from the recording portion 9. Having undergone duplex printing, the sheet P passes through the second conveyance unit 12 and the second sheet conveyance passage 4*b* in this order to be discharged onto the sheet discharge tray 15*a*.

The printer 100 further includes an automatic document conveyance device 14 and an image reading portion (not shown). The automatic document conveyance device 14 automatically feeds one sheet after another sequentially, out of a document comprising a bundle of sheets, to a contact glass (not shown). The image reading portion reads the document fed to the contact glass and thereby acquires the image data of the images to be formed on sheets P by ink ejection from the recording portion 9. The printer 100 also incudes another sheet discharge tray 15*b* onto which a sheet P having undergone duplex printing is discharged with the first side up.

Figure 2:
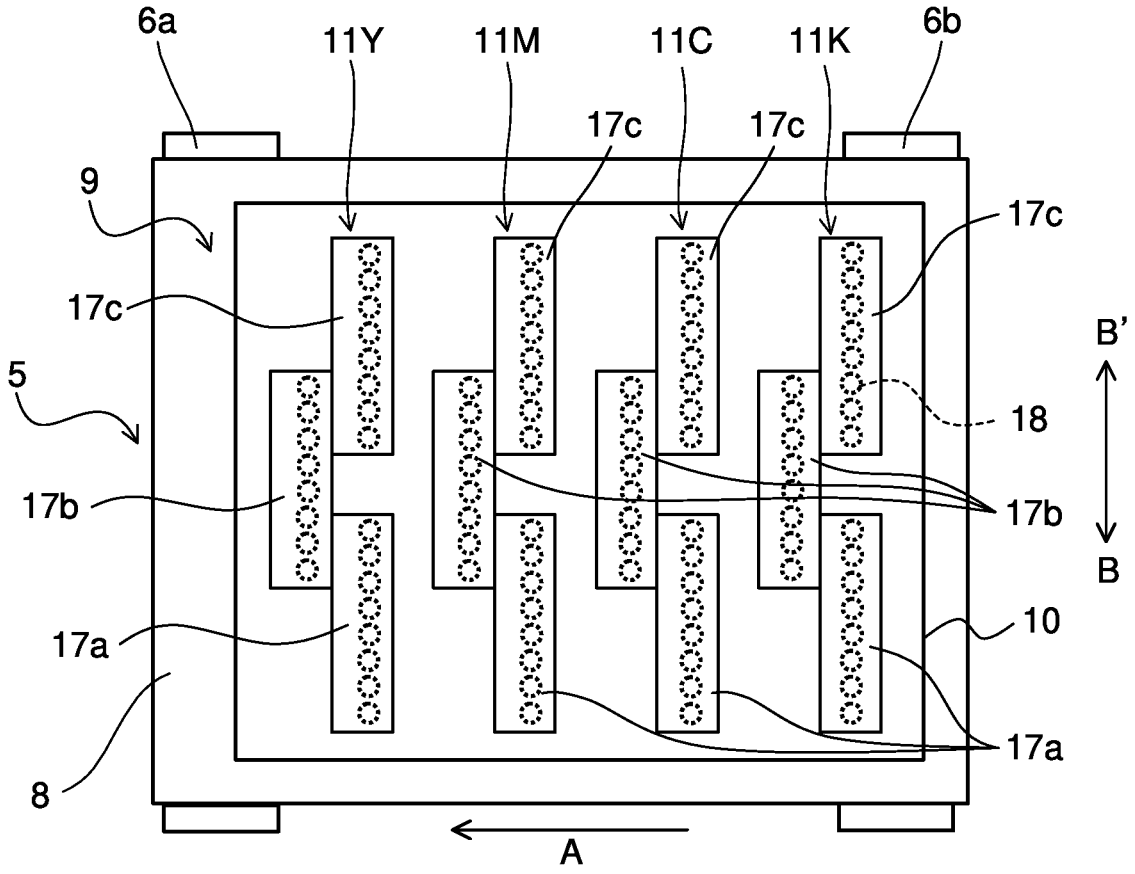
FIG. 2 is a plan view of a recording portion in the printer.

FIG. 2 is a plan view of the recording portion 9. The recording portion 9 includes a head housing 10 and line heads 11Y, 11M, 11C, and 11K. The line heads 11Y to 11K are held on the head housing 10 at a height, such as to leave a predetermined distance (e.g., 1 mm), from the conveyance surface of the first conveyance belt 8, which is an endless belt that is stretched around a plurality of rollers including a driving roller 6*a*, a driven roller 6*b*, and tension rollers 7*a*, 7*b*, and 7*c* (see FIG. 3). The driving roller 6*a* makes the first conveyance belt 8 move in the conveyance direction of the sheet P (the direction indicated by arrow A, referred to as direction A). The driving of the driving roller 6*a* is controlled by the controller 110 (see FIGS. 1 and 4). The rollers enumerated above are disposed in the following order along the movement direction of the first conveyance belt 8: the tension roller 7*a*, the tension roller 7*b*, the tension roller 7*c*, the driven roller 6*b*, and the driving roller 6*a* (see FIG. 3).

The line heads 11Y to 11K each include a plurality of (here three) recording heads 17*a* to 17*c*. The recording heads 17*a* to 17*c* are disposed in a staggered array along the sheet width direction (the direction indicated by arrows BB', referred to as direction BB') orthogonal to the sheet conveyance direction (the direction indicated by arrow A). The recording heads 17*a* to 17*c* each have a plurality of ink ejection apertures 18 (nozzles). The ink ejection apertures 18 are disposed in an equally spaced array in the width direction of the recording head, that is, in the sheet width direction (the direction indicated by arrows BB'). The line heads 11Y to 11K eject, through the ink ejection apertures 18 in the recording heads 17*a* to 17*c*, ink of different colors, namely yellow (Y), magenta (M), cyan (C), and black (K), onto the sheet P conveyed on the first conveyance belt 8.

Figure 3:
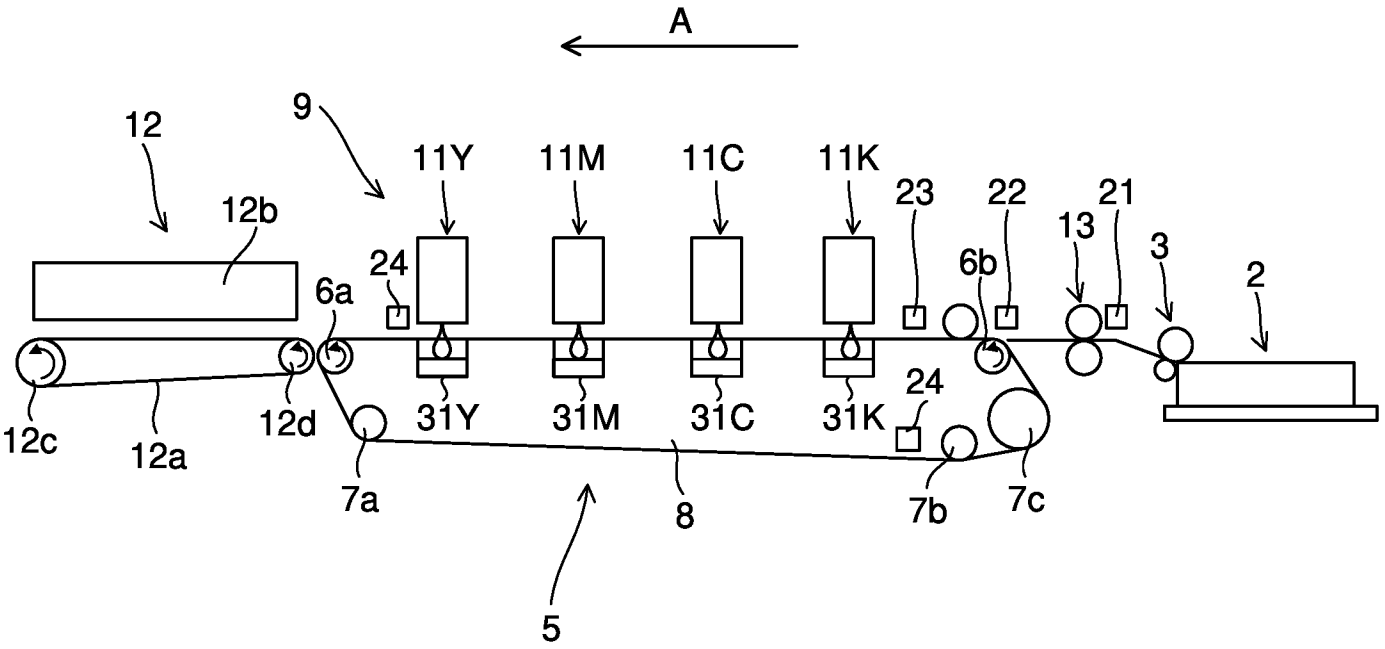
FIG. 3 is an illustrative diagram schematically showing the construction around a conveyance path for sheets from a sheet feed cassette via a first conveyance unit to a second conveyance unit in the printer.
Figure 4:
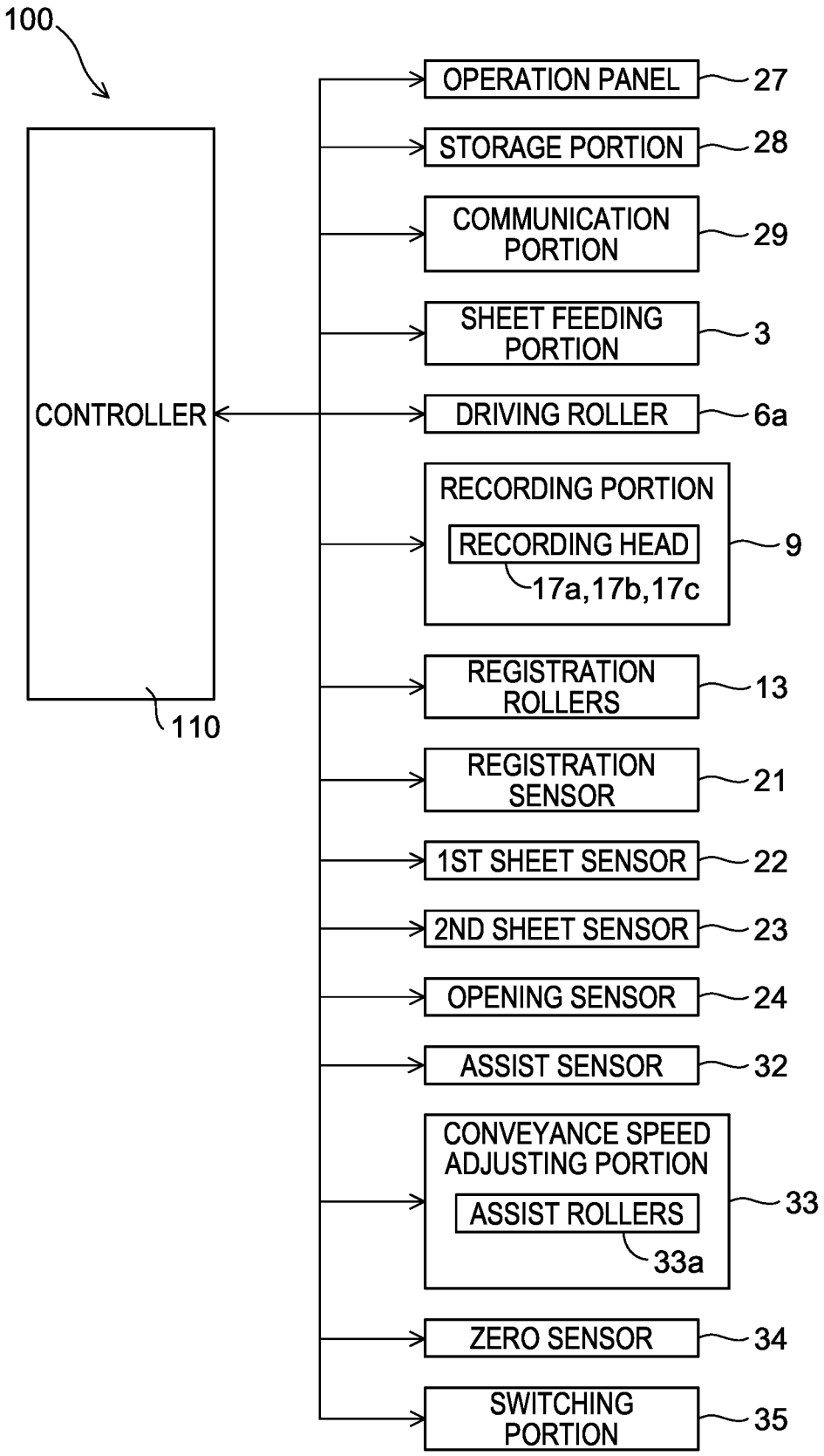
FIG. 4 is a block diagram showing the hardware configuration of relevant parts of the printer.

FIG. 3 schematically shows the construction around the conveyance path for sheets P from the sheet feed cassette 2 via the first conveyance unit 5 to the second conveyance unit 12. FIG. 4 is a block diagram showing the hardware configuration of relevant parts of the printer 100. The printer 100 includes, in addition to its components already mentioned, a registration sensor 21, a first sheet sensor 22, a second sheet sensor 23, and an opening sensor 24.

The registration sensor 21 senses the sheet P conveyed from the sheet feed cassette 2 by the sheet feeding portion 3 to be fed to the pair of registration rollers 13. The registration sensor 21 is disposed upstream of the pair of registration rollers 13 in the feeding direction of the sheet P. Based on the result of the sensing by the registration sensor 21, the controller 110 can control the timing with which the pair of registration rollers 13 starts to rotate. For example, based on the result of the sensing by the registration sensor 21, the controller 110 can control the timing with which the sheet P having undergone skew correction by the pair of registration rollers 13 is fed to the first conveyance belt 8.

The first sheet sensor 22 senses (the timing of) the passage of the sheet P fed from the pair of registration rollers 13 to the first conveyance belt 8. The first sheet sensor 22 is disposed upstream (at the side closer to the pair of registration rollers 13) of the position at which the first conveyance belt 8 meets the sheet P.

The second sheet sensor 23 senses the position, in the conveyance direction, of the sheet P conveyed on the first conveyance belt 8. The second sheet sensor 23 is disposed, in the sheet conveyance direction, upstream of the recording portion 9, downstream of the first sheet sensor 22. Based on the result of the sensing by the second sheet sensor 23, the controller 110 can control the timing with which ink is ejected onto the sheet P conveyed by the first conveyance belt 8 to the position opposite the line heads 11Y to 11K (recording heads 17*a* to 17*c*).

The opening sensor 24 senses the position of openings 80 (see FIG. 5; described later) provided in the first conveyance belt 8. As the first conveyance belt 8 moves, the openings 80 move (change their position). Thus the opening sensor 24 can be understood to sense the openings 80 that move as the first conveyance belt 8 moves. In the embodiment, the opening sensor 24 comprises two of them that are respectively disposed, with respect to the movement direction of the first conveyance belt 8, between the recording portion 9 and the driving roller 6*a* and between the tension roller 7*a* and the tension roller 7*b* to sense the openings 80. It may instead be disposed only at one of those positions or wherever else to sense the openings 80. Based on the result of the sensing of the openings 80 by the opening sensor 24, the controller 110 can drive the sheet feeding portion 3 (pickup roller 3*a*, feed roller 3*b*) to feed sheets P one by one from the sheet feeding portion 3 with predetermined feed-out timing.

The registration sensor 21, the first sheet sensor 22, the second sheet sensor 23, and the opening sensor 24 mentioned above can each be a transmissive or reflective optical sensor, a CIS sensor (contact image sensor), or the like.

The printer 100 may be configured to include a meandering sensor that senses the meandering of the first conveyance belt 8 and that, based on the result of the sensing, corrects the meandering of the first conveyance belt 8.

The printer 100 further includes an operation panel 27, a storage portion 28, a communication portion 29, and the controller 110. The controller 110 controls the operation of different parts in the printer 100. The controller 110 is configured, for example, to include a central arithmetic processing device such as what is called a CPU (central processing unit). The controller 110 also has a function as a timer that counts time.

The operation panel 27 serves as an operation portion that accepts the input of various settings. For example, a user can operate the operation panel 27 to enter information on the size of the sheets P stored in the sheet feed cassette 2. The user can also operate the operation panel 27 to enter the number of sheets P to print on and an instruction to start a print job.

The storage portion 28 is a memory that stores operation programs for the controller 110 as well as various kinds of information, and includes ROM (Read Only Memory), RAM (Random Access Memory), a nonvolatile memory and the like. For example, information entered on the operation panel 27 is stored in the storage portion 28.

The communication portion 29 is a communication interface for exchange of information with an external device (e.g., a personal computer [PC]). For example, in response to the user operating the PC and transmitting to the printer 100 a print command along with image data, the image data and the print command are fed via the communication portion 29 to the printer 100. In the printer 100, based on the image data the controller 110 controls the recording heads 17*a* to 17*c* to make them eject ink; thus an image can be recorded on a sheet P.

As shown in FIG. 3, at the inner surface side of the first conveyance belt 8, the printer 100 has ink pans 31Y, 31M, 31C, and 31K. The ink pans 31Y to 31K are disposed at positions opposite the recording heads 17*a* to 17*c* in the line heads 11Y to 11K across the first conveyance belt 8. When the recording heads 17*a* to 17*c* are made to perform flushing, the ink pans 31Y to 31K receive and collect the ink ejected from the recording heads 17*a* to 17*c* and having passed through the openings 80 in the first conveyance belt 8. Here flushing denotes the ejection of ink through the ink ejection apertures 18 that is performed with timing different from that for image formation (image recording) on a sheet P with the aim of alleviating or preventing the clogging of the ink ejection apertures 18 with dried ink. The ink collected in the ink pans 31Y to 31K is transported to a waste ink tank and is disposed of; it may be reused instead of being disposed of.

As shown in FIG. 4, the printer 100 further includes an assist sensor 32, a conveyance speed adjusting portion 33, and a zero sensor 34, of which details will be given later.

The second conveyance unit 12 shown in FIG. 3 includes a second conveyance belt 12*a* and a drier 12*b*. The second conveyance belt 12*a* is stretched around two rollers, namely a driving roller 12*c* and a driven roller 12*d*. The sheet P conveyed by the first conveyance unit 5 and having an image formed on it by ink ejection from the recording portion 9 is conveyed by the second conveyance belt 12*a* and is meanwhile dried by the drier 12*b*.

Figure 5:
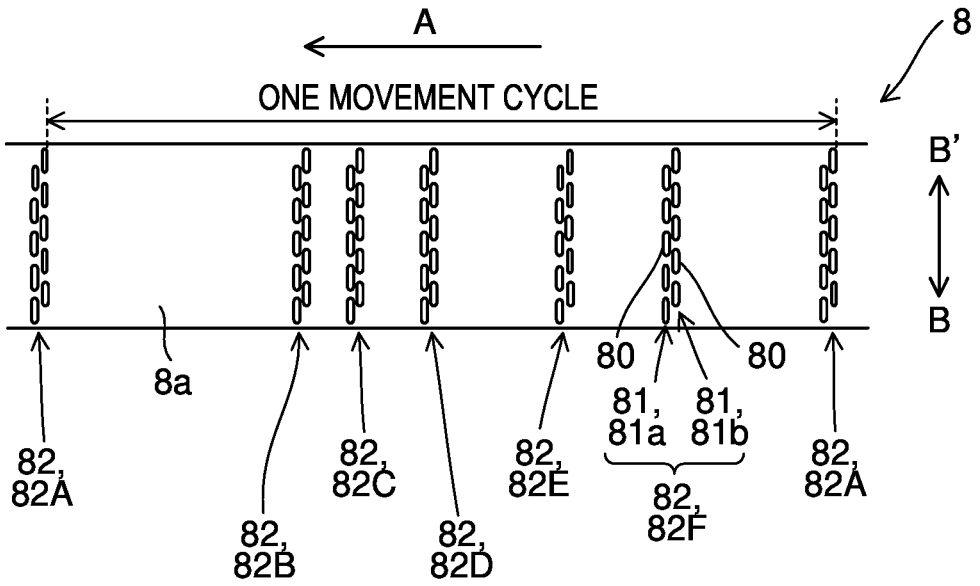
FIG. 5 is a plan view showing one configuration example of a first conveyance belt in the first conveyance unit.

2. Details of the First Conveyance Belt: Next the first conveyance belt 8 in the first conveyance unit 5 will be described in detail. FIG. 5 is a plan view showing one configuration example of the first conveyance belt 8. In the embodiment, the sheet P is conveyed under negative pressure suction. Accordingly, as shown in FIG. 5, the first conveyance belt 8 has a countless number of suction holes 8*a* formed in it to let suction air through.

The first conveyance belt 8 also has groups of openings 82 formed in it. The groups of openings 82 are a set of openings 80 through which, when flushing is performed, the ink ejected from the nozzles (ink ejection apertures 18) in the recording heads 17*a* to 17*c* is passed. The opening area of the opening 80 is larger than that of the suction hole 8*a* mentioned above. The first conveyance belt 8 has a plurality of groups of openings 82, six of them in the embodiment, per movement cycle in the conveyance direction of the sheet P (direction A). Where distinction is needed among the different groups of openings 82, the six groups of openings 82 are referred to as the groups of openings 82A to 82F in order from downstream in direction A. The suction holes 8*a* mentioned above are disposed between two adjacent ones of the groups of openings 82 in direction A. That is, no suction holes 8*a* are disposed in a region that overlaps the groups of openings 82.

The groups of openings 82 are disposed at irregular intervals in direction A within one movement cycle of the first conveyance belt 8; the interval between two adjacent ones of the groups of openings 82 is not constant but varies (between at least two intervals). Here the maximum interval between two adjacent groups of openings 82 in direction A (e.g., the interval between the groups of openings 82A and 82B in FIG. 5) is larger than the length, in direction A, of the sheet P of the smallest printable size (e.g., the A4 size [landscape]) as it is placed on the first conveyance belt 8.

The groups of openings 82 each have arrays of openings 81. The arrays of openings 81 each comprise a plurality of openings 80 arrayed in the belt width direction (sheet width direction, direction BB') orthogonal to direction A. One group of openings 82 has a plurality of arrays of openings 81, two of them in the embodiment, in direction A. Where distinction is needed between the two arrays of openings 81 one is referred to as the array of openings 81*a* and the other the array of openings 81*b*.

In one group of openings 82, the openings 80 in one array of openings 81 (e.g., the array of openings 81*a*) are disposed at positions displaced in direction BB' from the openings 80 in another array of openings 81 (e.g., the array of openings 81*b*), and are disposed at positions in direction A partly overlapping the openings 80 in another array of openings 81. In each array of openings 81, the plurality of openings 80 are disposed at equal intervals in direction BB'.

Disposing a plurality of arrays of openings 81 in direction A to form a group of openings 82 gives the groups of openings 82 a width in direction BB' larger than the width of the recording heads 17*a* to 17*c* in direction BB'. Thus the groups of openings 82 cover the entire ink ejection region of the recording heads 17*a* to 17*c* in direction BB', and the ink ejected from all the ink ejection apertures 18 in the recording heads 17*a* to 17*c* when flushing is performed passes through some of the openings 80 in the groups of openings 82.

Moreover, owing to the groups of openings 82 being disposed at irregular intervals in direction A within one movement cycle of the first conveyance belt 8, assuming that the first conveyance belt 8 moves at constant speed, the intervals in direction A at which the opening sensor 24 senses the openings 80 vary. Thus, based on the just-mentioned intervals of the groups of openings 82 as sensed by the opening sensor 24, the controller 110 can recognize which of the groups of openings 82 the openings 80 sensed by the opening sensor 24 at a given time belong to.

3. Pattern of Groups of Openings Used in Flushing: In the embodiment, while a sheet P is conveyed on the first conveyance belt 8 described above, based on image data from an external device (e.g., a PC), the controller 110 drives the recording heads 17*a* to 17*c* to record an image on the sheet P. Meanwhile, the recording heads 17*a* to 17*c* are made to perform flushing between one sheet P conveyed and the next P (sheet interval flushing) to alleviate or prevent the clogging of the ink ejection apertures 18.

For that purpose, the controller 110 determines the pattern (combination) of a plurality of groups of openings 82 in direction A to be used in flushing within one movement cycle of the first conveyance belt 8 in accordance with the size of the sheet P used. Incidentally, the size of the sheet P used can be recognized by the controller 110 based on the information stored in the storage portion 28 (information on the size of the sheet P as entered on the operation panel 27).

Figure 6:
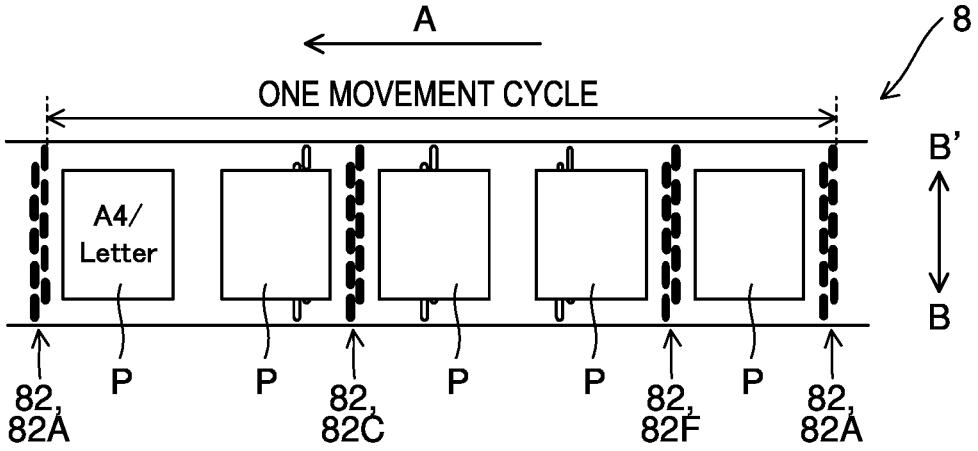
FIG. 6 is an illustrative diagram schematically showing a pattern of groups of openings used in flushing.

FIG. 6 schematically shows a pattern of the groups of openings 82 in direction A used in flushing when the sheet P used is of the A4 size (landscape) or of the letter size (landscape). In FIG. 6, for convenience' sake, the openings 80 in the groups of openings 82 belonging to the just-mentioned pattern are shown solid black. As shown there, when the sheet P used is of the A4 size (landscape), the controller 110 selects and decides on, out of the six groups of openings 82 shown in FIG. 5, the groups of openings 82A, 82C, and 82F as the groups of openings 82 to be used in flushing.

In the following description, the groups of openings 82A, 82C, and 82F to be used in flushing will be referred to also as "particular groups of openings 82"; likewise the openings 80 included in the particular groups of openings 82 to be used in flushing will be referred to also as "particular openings 80".

The controller 110 makes the recording heads 17*a* to 17*c* perform flushing with such timing that, as the first conveyance belt 8 moves, the particular groups of openings 82 disposed in the determined pattern are located opposite the recording heads 17*a* to 17*c*. Here the movement speed of the first conveyance belt 8 (i.e., the sheet conveyance speed), the intervals between the groups of openings 82A to 82E, and the position of the recording heads 17*a* to 17*c* relative to the first conveyance belt 8 are all previously known. Thus, when, as the first conveyance belt 8 moves, the passage of the group of openings 82 taken as the reference (e.g., the group of openings 82A) is sensed by the opening sensor 24, how many seconds after that the groups of openings 82A to 82E pass across the position opposite the recording heads 17*a* to 17*c* can be predicted. Accordingly, based on the sensing timing, that is, the sensing result, of the opening sensor 24, the controller 110 can make the recording heads 17*a* to 17*c* perform flushing with such timing that the particular groups of openings 82 disposed in the pattern determined as described above are located opposite the recording heads 17*a* to 17*c*.

4. Pattern of Placement of Sheets on the First Conveyance Belt: The controller 110 controls the sheet feeding portion 3 and the pair of registration rollers 13 to feed a sheet P to the first conveyance belt 8 in such a way that the sheet P is placed on the first conveyance belt 8 at a position displaced in direction A from a particular group of openings 82 disposed in the determined pattern.

For example, when the sheet P used is of the A4 size (landscape) or of the letter size (landscape), then as shown in FIG. 6 the controller 110 has sheets P fed out from the sheet feeding portion 3 and fed via the pair of registration rollers 13 onto the first conveyance belt 8 with predetermined timing such that two sheets P are placed between the particular groups of openings 82A and 82C, that two sheets P are placed between the particular groups of openings 82C and 82F, and that one sheet P is placed between the particular groups of openings 82F and 82A.

Here, in the embodiment, with the aim of increasing productivity (the number of sheets that can be printed per unit time), the sheets P fed out from the sheet feeding portion 3 are so controlled as to be fed onto the first conveyance belt 8 with hardly any suspension at the pair of registration rollers 13. With this control, hastening the feed-out timing of sheets P from the sheet feeding portion 3 leads to higher productivity. That is, the timing with which sheets P are fed out from the sheet feeding portion 3 determines productivity.

The feed-out timing of sheets P from the sheet feeding portion 3 is determined by the controller 110 based on the result of the sensing by the opening sensor 24. For example, assume that the conveyance speed of the first conveyance belt 8 is previously known, and that the distance across which the first conveyance belt 8 moves from the sensing position of the opening sensor 24 to the meeting position between the first conveyance belt 8 and the sheet P is also previously known. Then the controller 110 can predict how many seconds after, as the first conveyance belt 8 moves, the passage of the group of openings 82 taken as the reference (e.g., the group of openings 82A) is sensed by the opening sensor 24 the particular openings 80 to be used in flushing, or a particular position on the first conveyance belt 8 displaced in the conveyance direction from the particular openings 80, reach the above-mentioned meeting position. The particular position just mentioned is, for example, a position as shown in FIG. 6 at which, assuming that a sheet P is placed on the first conveyance belt 8 so as not to overlap the particular openings 80 to be used in flushing, the leading edge of the sheet P (its downstream-side edge in the movement direction) makes contact with the first conveyance belt 8.

Accordingly, the controller 110 makes the sheet feeding portion 3 start feeding out a sheet P with timing that is earlier by a predetermined time than the time point at which the sheet P reaches (meets) a particular position on the first conveyance belt 8 displaced in the conveyance direction from particular openings 80 among the plurality of openings 80 sensed by the opening sensor 24. That is, the just-mentioned timing is the feed-out timing of the sheet P from the sheet feeding portion 3. The predetermined time mentioned above is a predefined conveyance time of a sheet P required for the sheet P to travel from the sheet feeding portion 3 to the first conveyance belt 8 via the shared conveyance passage XA and, of the plurality of branch conveyance passages XB, the one with the longest conveyance distance for the sheet P (e.g., the first branch conveyance passage XB1).

As a result of the sheet P being fed from the sheet feeding portion 3 with the feed-out timing described above, so long as sheets P are conveyed with no conveyance delay as will be described later, they can be placed, as shown in FIG. 6, substantially at equal intervals on the first conveyance belt 8, between particular openings 80 and particular openings 80, that is, at positions displaced in the conveyance direction from particular openings 80. In the example shown in FIG. 6, five sheets P can be conveyed in one movement cycle of the first conveyance belt 8, and it is possible to achieve 150 ipm (images per minutes) as the number of sheets P printed per minute (productivity).

Figure 7:
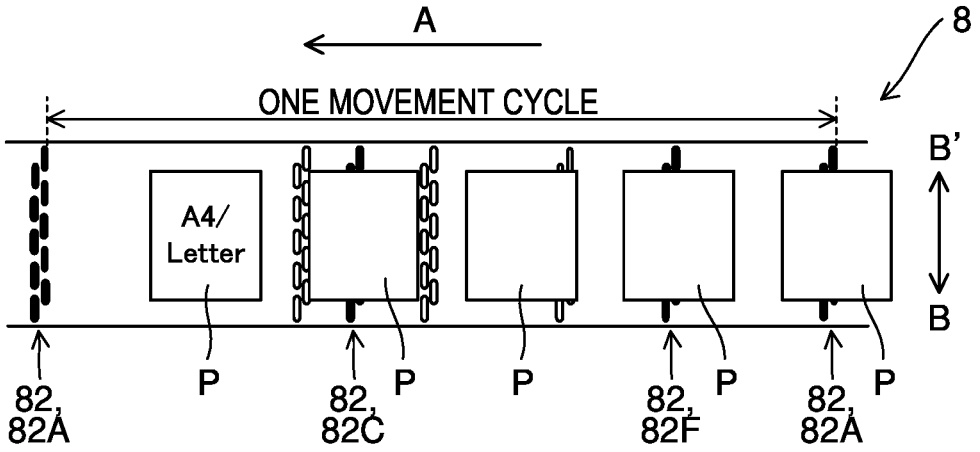
FIG. 7 is a diagram showing a state where, on the first conveyance belt, a sheet is placed to overlap particular openings used in flushing.

5. Conveyance Delay of Sheets: The sheets P that are fed out of the sheet feed cassette 2 (see FIG. 1) by the pickup roller 3*a* and separated and fed forward one by one by the feed roller 3*b* and the retard roller 3*c* may slip on the surface of the feed roller 3*b*. If this happens, a sheet P is conveyed with a delay and does not reach the above-mentioned particular position on the first conveyance belt 8 in time. As a result, for example as shown in FIG. 7, the sheet P may be placed on the first conveyance belt 8 so as to overlap the particular openings 80 used in flushing (e.g., the openings 80 in the particular group of openings 82C). In this state it is not possible to make the recording heads 17*a* to 17*c* perform flushing involving ink ejection toward those particular openings 80.

For another example, when a plurality of sheets P are sequentially fed to the first conveyance belt 8, if a conveyance delay occurs with the second or later sheet P, the first sheet P is expected to have already been placed on the first conveyance belt 8 and be undergoing printing. Thus it is inappropriate to reduce the movement speed of the first conveyance belt 8 in the middle of printing on the first sheet P to permit the second sheet P with the conveyance delay to reach the particular position on the first conveyance belt 8.

On the other hand, if a conveyance delay of a sheet P requires flushing to be performed through the next openings 80 on the first conveyance belt 8, it is necessary to reduce the conveyance speed for the sheet P in such a way that the sheet P is placed on the first conveyance belt 8 in a position displaced in the conveyance direction from those next openings 80. With a reduced conveyance speed for the sheet P, even a slight slip of a sheet P leads to large sheet-to-sheet intervals, and this may result in a notably lower productivity (number of sheets printed). A conveyance delay of a sheet P can be compensated for by solely increasing the conveyance speed for the sheet P. However, on an apparatus capable of high-speed printing or one designed with a short conveyance passage for sheets P, the conveyance speed cannot be increased beyond a certain limit.

To cope with that, in the embodiment, the controller 110 recognizes the time of a conveyance delay of a sheet P in the following manner and, based on the recognized conveyance delay time, controls the switching portion 35 to make it switch the conveyance destination of the sheet P to one of the plurality of branch conveyance passages XB. In that way, even if a sheet P has a conveyance delay, it is possible to make the recording heads 17*a* 17*c* perform flushing through the particular openings 80 without reducing productivity.

Prior to a detailed description of the controller 110, a description will first be given of the assist sensor 32, the conveyance speed adjusting portion 33, and the zero sensor 34 mentioned earlier that are provided in the printer 100 according to the embodiment.

Figure 8:
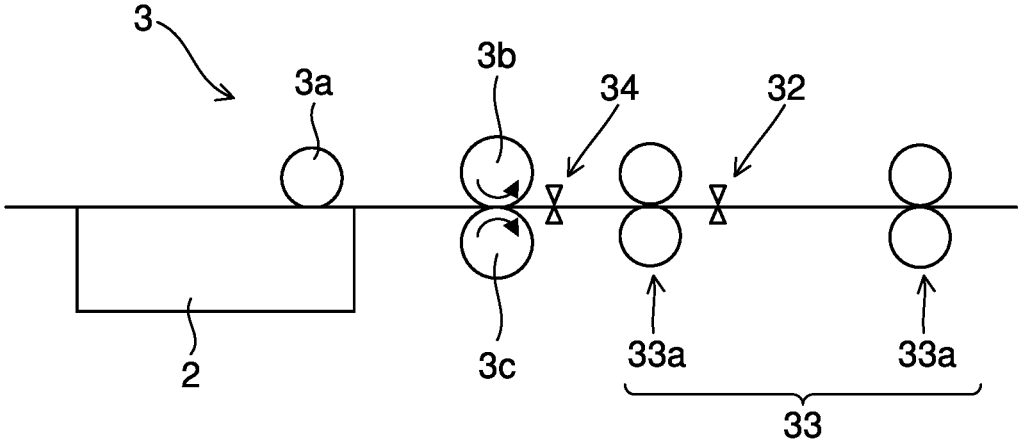
FIG. 8 is an illustrative diagram schematically showing in detail the construction around a sheet feeding portion in the printer.

FIG. 8 is an illustrative diagram schematically showing in detail the construction around the sheet feeding portion 3 in the printer 100. Downstream of the feed roller 3*b* and the retard roller 3*c* in the sheet conveyance direction, the assist sensor 32 is disposed. The assist sensor 32 is a recording medium sensor that senses a sheet P fed out from the sheet feeding portion 3 (e.g., out through the nip between the feed roller 3*b* and the retard roller 3*c*).

Based on the sensing of a sheet P by the assist sensor 32, the controller 110 can recognize whether there is a conveyance delay of the sheet P. For example, let Tmeasure (sec) be the actual elapsed time from the start time point of the rotation of the feed roller 3*b*, that is, from the start time point of the feeding-out of the sheet P by the sheet feeding portion 3, to the sensing timing of the sheet P by the assist sensor 32, let Tdef (sec) be a predefined initially set time from the start time point of the feeding-out of the sheet P by the sheet feeding portion 3 to the sensing timing of the sheet P by the assist sensor 32 (i.e., the theoretical conveyance time of the sheet P with no conveyance delay), and let Tslip (sec) be the conveyance delay time of the sheet P. Then Tslip=Tmeasure−Tdef. If Tslip=0, the controller 110 can recognize the sheet P to have no conveyance delay; otherwise, the controller 110 can recognize the sheet P to have a conveyance delay.

Put another way, if the sensing timing is later than predetermined timing that is later by the initially set time than the start time point of the feeding-out of the sheet P by the sheet feeding portion 3, the controller 110 can recognize the sheet P to have a conveyance delay. The conveyance delay time Tslip mentioned above equals the value that results from subtracting the theoretical sensing timing assuming no conveyance delay of the sheet P from the time point at which, i.e., the sensing timing with which, the sheet P is actually sensed.

The conveyance speed adjusting portion 33 conveys the sheet P fed out from the sheet feeding portion 3 toward the first conveyance belt 8 and adjusts the conveyance speed of the sheet P. The conveyance speed adjusting portion 33 includes a pair of assist rollers 33*a* comprising at least one pair of conveyance rollers. The assist sensor 32 is disposed downstream of the pair of assist rollers 33*a* that is disposed most upstream.

The pair of assist rollers 33*a* have two rollers that are disposed opposite each other. Of the two rollers, one is a driving roller that is driven under the control of the controller 110, and the other is a driven roller that rotates in pressed contact with the former. The controller 110 can, by controlling the rotation speed (circumferential velocity) of the driving roller, adjust (increase and reduce) the conveyance speed of the sheet P conveyed by the pair of assist rollers 33*a*.

The zero sensor 34 is disposed downstream of the feed roller 3*b* and the retard roller 3*c* in the sheet conveyance direction, upstream of the pair of assist rollers 33*a* disposed most upstream. The zero sensor 34 senses the trailing edge of the sheet P fed out from the feed roller 3*b* and the retard roller 3*c*. Thus, based on the result of the sensing by the zero sensor 34, the controller 110 can control the driving of the feed roller 3*b* and the pickup roller 3*a* so as to keep constant the (sheet-to-sheet) intervals between the sheets P that are fed out continuously.

The assist sensor 32 and the zero sensor 34 are each, for example, a transmissive or reflective optical sensor.

Figure 9:
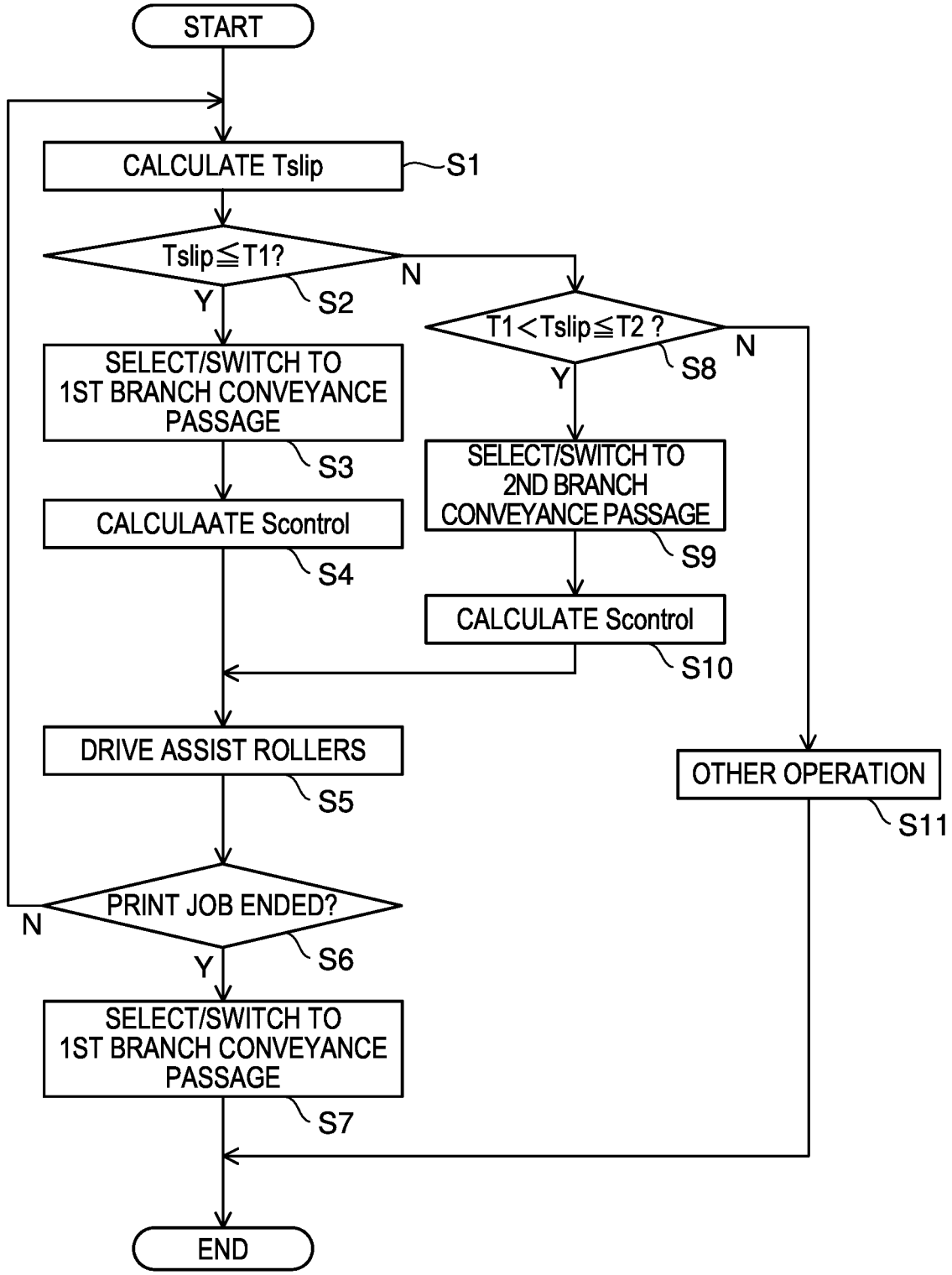
FIG. 9 is a flow chart showing a procedure for control based on a conveyance delay time of a sheet.

Conveyance Control Based on the Conveyance Delay Time of a Sheet: FIG. 9 is a flow chart showing a procedure for control based on a conveyance delay time of a sheet fed out from the sheet feeding portion 3 in the printer 100 according to the embodiment. First, as described above, based on the elapsed time Tmeasure and the initially set time Tdef, the controller 110 calculates and recognizes the conveyance delay time Tslip (S1).

Next, the controller 110 checks whether Tslip is equal to or less than a predetermined time T1 (sec) (S2). Here, let LC (mm) be the conveyance distance of the sheet P from the assist sensor 32 to the branch point F (see FIG. 1) of the plurality of branch conveyance passages XB, let L1 (mm) be the conveyance distance of the sheet P in the first branch conveyance passage XB1, let Sdef (mm/sec) be the predefined conveyance speed of the sheet P, and let Smax (mm/sec) be the upper limit value of the conveyance speed of the sheet P up to which the pair of assist rollers 33*a* can adjust it. Then, the above-mentioned predetermined time T1 is given by $$T1=(LC+L1)/Sdef-(LC+L1)/Smax. \quad (A)$$

If at S2 Tslip≤T1, the controller 110 judges that the conveyance delay of the sheet P can be compensated for by adjusting (e.g., increasing) the rotation speed of the pair of assist rollers 33*a* even if the conveyance destination of the sheet P from the shared conveyance passage XA continues to be the first branch conveyance passage XB1 (even if it is not switched from the first branch conveyance passage XB1 to the second branch conveyance passage XB2). Accordingly, the controller 110 selects the first branch conveyance passage XB1 as the conveyance destination of the sheet P, and controls the switching portion 35 so that the sheet P passes through the first branch conveyance passage XB1 (S3). If the conveyance destination of the sheet P has already (e.g., by default) been switched to the first branch conveyance passage XB1, S3 can be skipped.

Next, the controller 110 calculates the conveyance speed Sconrol (mm/sec) at which it can compensate for the conveyance delay of the sheet P (S4). The conveyance speed Sconrol can be calculated specifically in the following manner.

Let TM (sec) be the conveyance time required to convey the sheet P from the assist sensor 32 to the junction G (see FIG. 1) of the plurality of branch conveyance passages XB via the shared conveyance passage XA. Then $$TM=(LC+L1)/S\text{def}. \quad (B)$$

To compensate for the conveyance delay of the sheet P, the sheet P needs to be conveyed from the assist sensor 32 via the first branch conveyance passage XB1 to the junction G in the time (TM−Tslip). That is, let Tcontrol (sec) be the time required to compensate for the conveyance delay of the sheet P, then $$TM-T\text{slip}=T\text{control}, \quad (C)$$

Here $$T\text{control}=(LC+L1)/S\text{control}. \quad (D)$$

Expressions (B) to (D) give Expression (E) below:

$$(LC+L1)/S\text{def}-T\text{slip}=(LC+L1)/S\text{control} \quad (E).$$

Thus, according to Expression (E) the controller 110 can calculate the conveyance speed Sconrol of the sheet P.

When at S4 the conveyance speed Sconrol is calculated, the controller 110 controls the driving of the pair of assist rollers 33*a* so that the sheet P is conveyed at the conveyance speed Sconrol (S5). Thus, even if the sheet P has a conveyance delay, when the sheet P reaches the junction G via the first branch conveyance passage XB1, the conveyance delay is cancelled. Then the sheet P meets the first conveyance belt 8 with the normal timing (the timing observed with no conveyance delay).

S1 and the following steps described above are performed before the end of image formation (a print job) on at least one sheet P. When the print job ends, the controller 110 selects the first branch conveyance passage XB1 as the conveyance destination of the sheet P, and then in preparation for the next print job, controls the switching portion 35 so that the sheet P will pass through the first branch conveyance passage XB1 (S7). If at S6 the conveyance destination of the sheet P has already been switched to the first branch conveyance passage XB1, S7 can be skipped.

In contrast, if S2 results in "No" and T1<Tslip≤T2 (S8, "Yes"), the controller 110 judges that, so long as the conveyance destination of the sheet P from the shared conveyance passage XA continues to be the first branch conveyance passage XB1, increasing the rotation speed of the pair of assist rollers 33*a* up to the upper limit value (Smax) will not compensate for the conveyance delay of the sheet P. In this case, the controller 110 selects the second branch conveyance passage XB2 as the conveyance destination of the sheet P, and controls the switching portion 35 to make it switch the conveyance destination of the sheet P from the first branch conveyance passage XB1 to the second branch conveyance passage XB2 (S9).

The variable T2 (sec) above represents the shortest conveyance time of the sheet P that is conveyed from the assist sensor 32 via the second branch conveyance passage XB2 to the junction G. This shortest conveyance time T2 is achieved by driving the assist sensor 32 such that the rotation speed of the pair of assist rollers 33*a* equals the upper limit value Smax. Let L2 (mm) be the conveyance distance of the sheet P in the second branch conveyance passage XB2, the conveyance time T2 is given by Expression (F) below.

$$T2=(LC+L1)/S\text{def}-(LC+L2)/S\text{max}. \quad (F)$$

Subsequently the controller 110 calculates the conveyance speed Sconrol (mm/sec) at which if the sheet P is passed through the second branch conveyance passage XB2 the conveyance delay of the sheet P can be compensated for. At S10 the conveyance speed Sconrol can be calculated specifically in the following manner.

To compensate for the conveyance delay of the sheet P, it is necessary to convey the sheet P from the assist sensor 32 via the branch conveyance passage XB to the junction G in the time (TM−Tslip). Let Tcontrol (sec) be the time required to compensate for the conveyance delay of the sheet P, then it is given by $$T\text{control}=(LC+L2)/S\text{control}. \quad (D')$$

Expressions (B) and (C) noted earlier combined with Expression (D') give Expression (E') below.

$$(LC+L1)/S\text{def}-T\text{slip}=(LC+L2)/S\text{control}. \quad (E')$$

Thus the controller 110 can calculate the conveyance speed Sconrol of the sheet P according to Expression (E').

When at S10 the conveyance speed Sconrol is calculated, the controller 110 controls the driving of the pair of assist rollers 33*a* so that the sheet P is conveyed at the conveyance speed Sconrol (S5). Thus, even if the sheet P has a conveyance delay, when the sheet P reaches the junction G via the second branch conveyance passage XB2, the conveyance delay is cancelled. Then the sheet P meets the first conveyance belt 8 with the normal timing (the timing with no conveyance delay).

If S8 results in "No", that is, if Tslip>T2, the controller 110 judges that the conveyance delay time Tslip of the sheet P is too long to compensate for the conveyance delay even by switching among a plurality of branch conveyance passages XB and adjusting the rotation speed of the pair of assist rollers 33*a*. In this case, the controller 110 controls relevant parts of the printer 100 to perform other operation (S11), and ends the sequence of operation.

For example, if at S11 duplex printing is performed, the conveyance of the sheet P in either of the first sheet conveyance passage 4*a* and the reversing conveyance passage 16 is suspended. This prevents collision between the sheet P having undergone simplex printing that is conveyed along the reversing conveyance passage 16 and the sheet P with a conveyance delay that is conveyed along the first sheet conveyance passage 4*a*. For another example, when a plurality of (e.g., five) sheets P are intended to be conveyed continuously, the conveyance of a sheet P with a conveyance delay (e.g., the fourth sheet P) and of any following sheet P (e.g., the fifth sheet P) can be delayed sequentially. In this case, though in exchange for lower productivity, the fourth and following sheets P can be placed at particular positions on the first conveyance belt 8 displaced in the conveyance direction from the openings 80.

Figure 10:
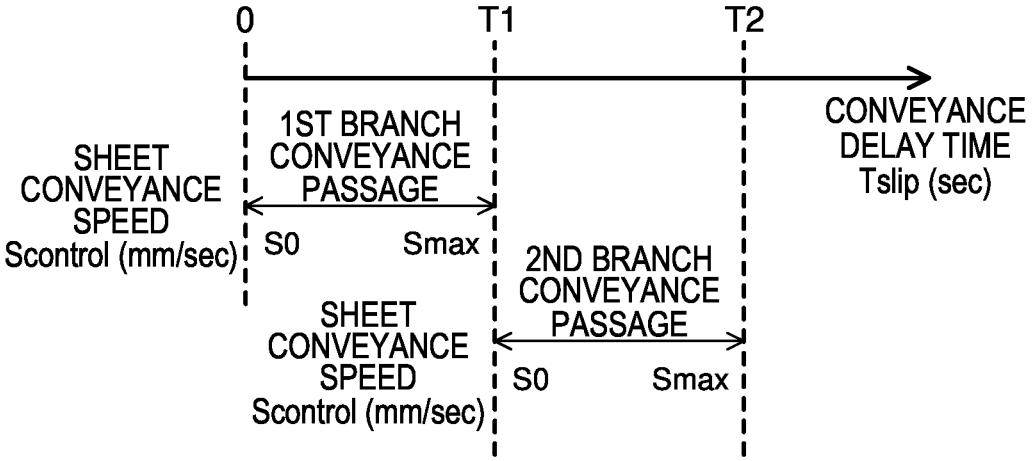
FIG. 10 is an illustrative diagram schematically showing the relationship between the conveyance delay time of a sheet and the conveyance speed of the sheet in a first and a second branch conveyance passage.

FIG. 10 schematically shows the relationship between the conveyance delay time Tslip of the sheet P and the conveyance speed Sconrol of the sheet P in the first and second branch conveyance passages XB1 and XB2. Under the above-described control by the controller 110, the conveyance destination of the sheet P is switched to the first or second branch conveyance passage XB1 or XB2 based on the conveyance delay time Tslip. Specifically, when 0<Tslip≤T1, the conveyance destination of the sheet P is switched to the first branch conveyance passage XB1 (S3); when T1<Tslip≤T2, the conveyance destination of the sheet P is switched to the second branch conveyance passage XB2 (S9).

For the sheet P passing through the first branch conveyance passage XB1, if Tslip=0, the driving of the pair of assist rollers 33*a* is so controlled as to adjust the conveyance speed Sconrol to S0 (mm/sec). Here S0 may be equal to Sdef, or may be a speed lower than Sdef. In contrast, if Tslip=T1, the driving of the pair of assist rollers 33*a* is so controlled as to adjust the conveyance speed Sconrol to Smax (mm/sec). If 0<Tslip<T1, the driving of the pair of assist rollers 33*a* is so controlled as to adjust the conveyance speed Sconrol such that it increases monotonically from S0 to Smax as Tslip increases.

For the sheet P passing through the second branch conveyance passage XB2, the conveyance speed Sconrol of the sheet P is so controlled as to increase monotonically from S0 to Smax as Tslip increases. In the embodiment, the lengths of (the conveyance distances along) the first and second branch conveyance passages XB1 and XB2 are so set that, with Tslip=T1, if the sheet P passes through the first branch conveyance passage XB1 at the conveyance speed Smax or if the sheet P passes through the second branch conveyance passage XB2 at the conveyance speed S0, in either case the sheet P takes the same conveyance time to travel from the assist sensor 32 to the junction G. Accordingly, with Tslip=T1, either the conveyance destination is switched to the first branch conveyance passage XB1 with the conveyance speed set at Smax or the conveyance delay is switched to the second branch conveyance passage XB2 with the conveyance speed set at S0. In this way, by switching among a plurality of branch conveyance passages XB with different conveyance distances and controlling the conveyance speed of the sheet P, so long as the conveyance delay time Tslip falls between 0 and T2, a conveyance delay of the sheet P can be compensated for.

6. Effects: As described above, in the printer 100 according to the embodiment, the plurality of branch conveyance passages XB include those with different conveyance distances for the sheet P (e.g., the first and second branch conveyance passages XB1 and XB2). Based on the sensing timing of the sheet P by the assist sensor 32, the controller 110 controls the switching portion 35 to make it switch the conveyance destination of the sheet P to one of the plurality of branch conveyance passages XB. Specifically, based on the elapsed time Tmeasure from the start time point of the feeding-out of the sheet P by the sheet feeding portion 3 to the sensing timing of the sheet P by the assist sensor 32, the controller 110 recognizes the conveyance delay time Tslip of the sheet P, and based on the conveyance delay time Tslip, controls the switching portion 35 to make it switch the conveyance destination of the sheet P to one of the plurality of branch conveyance passages XB.

Owing to the plurality of branch conveyance passages XB having mutually different conveyance distances for the sheet P, it is possible, by switching among the plurality of branch conveyance passages XB, to adjust the conveyance distance and the conveyance time of the sheet P in accordance with the conveyance delay time Tslip. For example, it is possible, by switching the conveyance destination from the first branch conveyance passage XB1 to the second branch conveyance passage XB2, to shorten the conveyance time of the sheet P and compensate for the conveyance delay of the sheet P.

Thus, even if a sheet P has a conveyance delay, it is possible to place the sheet P at a predetermined position on the first conveyance belt 8 relative to the openings 80 (e.g., at a position displaced in the conveyance direction from the opening 80) and make the recording heads 17*a* to 17*c* perform flushing involving ink ejection through the openings 80.

In particular, the controller 110 switches the conveyance destination of the sheet P among the branch conveyance passages XB depending on whether, based on the sensing timing of the sheet P by the assist sensor 32, controller 110 recognizes or does not recognize a conveyance delay of the sheet P that amounts to a predetermined time. In other words, the controller 110 switches the conveyance destination of the sheet P among the branch conveyance passages XB depending on whether the sensing timing of the sheet P by the assist sensor 32 is earlier or later than predetermined timing that is a predetermined time (e.g., an initially set time Tdef) later than the start time point of the feeding-out of the sheet P by the sheet feeding portion 3. This reliably provides the above-mentioned effect.

Moreover, based on the elapsed time Tmeasure and the predefined initially set time Tdef from the start time point of the feeding-out of the sheet P by the sheet feeding portion 3 to the sensing timing of the sheet P by the assist sensor 32, the controller 110 recognizes the conveyance delay time Tslip. For example, the controller 110 can recognize the conveyance delay time Tslip by calculating the difference between the elapsed time Tmeasure and the initially set time Tdef. It is thus possible to reliably recognize the conveyance delay time Tslip.

Based on the conveyance delay time Tslip, the controller 110 controls, in addition to the switching portion 35, also the pair of assist rollers 33*a* as the conveyance speed adjusting portion 33. Specifically, the controller 110 controls the pair of assist rollers 33*a* as the conveyance speed adjusting portion 33 to make the conveyance speed of the sheet P when the sensing timing of the sheet P by the assist sensor 32 is later than predetermined timing that is later by a predetermined time than the start time point of the feeding-out of the sheet P by the sheet feeding portion 3 higher than when the sensing timing is earlier than the predetermined timing.

The switching of the conveyance destination (among the branch conveyance passages XB) by the switching portion 35 permits a conveyance delay of the sheet P to be adjusted only in as many ways as there is branch conveyance passages XB. For example, in a construction where, as in the embodiment, the plurality of branch conveyance passages XB consist of two of them, namely the first and second branch conveyance passages XB1 and XB2, switching between the first and second branch conveyance passages XB1 and XB2 permits a conveyance delay of the sheet P to be adjusted only in two steps. In contrast, if by the action of the pair of assist rollers 33*a* the conveyance speed of the sheet P is also adjusted, it is possible, for each of the first and second branch conveyance passages XB1 and XB2, to adjust the conveyance speed of the sheet P passing there and thereby adjust the conveyance time of the sheet P in a stepless manner (continuously) (see FIG. 10). This helps reliably widen the range in which a conveyance delay of the sheet P can be compensated for. As a result, even if a sheet P has a conveyance delay, it is possible to accurately perform adjustment to compensate for the conveyance delay so that the sheet P is positioned and placed accurately at a particular position on the first conveyance belt 8.

In a construction where the branch conveyance passages XB include a first branch conveyance passage XB1 and a second branch conveyance passage XB2, with the latter having a conveyance distance shorter than the former, the controller 110 controls the switching portion 35 so that, if Tslip is equal to or less than T1, the sheet P passes through the first branch conveyance passage XB1. In this case, as noted earlier, $$T1=(LC+L1)/Sdef-(LC+L1)/Smax, \quad (A)$$

and thus it can be said that the controller 110 controls the switching portion 35 so that the sheet P passes through the first branch conveyance passage XB1 if $$Tslip \leq (LC+L1)/Sdef-(LC+L1)/Smax \quad \text{Condition (1):}$$

is satisfied.

By controlling the switching portion 35 so that the sheet P passes through the first branch conveyance passage XB1 if Condition (1) is satisfied, it is possible to compensate for a conveyance delay of the sheet P while adjusting the conveyance speed of the sheet P passing through the shared conveyance passage XA and the first branch conveyance passage XB1 to the upper limit value (Smax) or less.

In particular, the controller 110 controls the pair of assist rollers 33*a* as the conveyance speed adjusting portion 33 so that the sheet P is conveyed along the shared conveyance passage XA and the first branch conveyance passage XB1 at the conveyance speed Sconrol that satisfies Expression (E) noted earlier. Thus, even when the first branch conveyance passage XB1 is selected as the conveyance destination of the sheet P, it is possible to reliably compensate for the conveyance delay of the sheet P and let the sheet P meet the first conveyance belt 8 with the same timing as when there is no conveyance delay.

Let L2 (mm) be the conveyance distance of the sheet P in the branch conveyance passage XB, then the controller 110 controls the switching portion 35 so that the sheet P passes through the second branch conveyance passage XB2 if $T1<Tslip\leq T2$. In this case, as note earlier, $$T2=(LC+L1)/Sdef-(LC+L2)/Smax, \quad (F)$$

and thus it can be said that the controller 110 controls the switching portion 35 so that the sheet P passes through the second branch conveyance passage XB2 if $$Tslip>(LC+L1)/Sdef-(LC+L1)/Smax \text{ and} \quad \text{Condition (2):}$$

$$Tslip\leq(LC+L1)/Sdef-(LC+L2)/Smax \quad \text{Condition (3):}$$

are satisfied

By controlling the switching portion 35 so that the sheet P passes through the second branch conveyance passage XB2 if Conditions (2) and (3) are satisfied, it is possible to compensate for the conveyance delay of the sheet P while adjusting the conveyance speed of the sheet P passing through the shared conveyance passage XA and the second branch conveyance passage XB2 to the upper limit value (Smax) or less. Thus, even in a situation where a conveyance delay of the sheet P cannot be compensated for by switching the conveyance destination to the first branch conveyance passage XB1 and adjusting the conveyance speed of the sheet P passing through the first branch conveyance passage XB1, it is possible, by switching the conveyance destination to the second branch conveyance passage XB2 and adjusting the conveyance speed of the sheet P passing through the second branch conveyance passage XB2, to compensate for the conveyance delay of the sheet P.

In particular, the controller 110 controls the pair of assist rollers 33*a* as the conveyance speed adjusting portion 33 so that the sheet P passes through the shared conveyance passage XA and the second branch conveyance passage XB2 at the conveyance speed Sconrol that satisfies Expression (E') noted earlier. Thus, even when the second branch conveyance passage XB2 is selected as the conveyance destination of the sheet P, it is possible to reliably compensate for the conveyance delay of the sheet P and let the sheet P meet the first conveyance belt 8 with the same timing as when there is no conveyance delay.

The conveyance speed adjusting portion 33 includes the pair of assist rollers 33*a* as at least one pair of rollers for conveying the sheet P. Owing to the controller 110 adjusting the rotation speed of the at least one pair of assist rollers 33*a*, it is possible to reliably adjust (e.g., increase) the conveyance speed of the sheet P.

On completion of a print job in which image formation is performed by ink ejection onto at least one sheet P conveyed via the second branch conveyance passage XB2, the controller 110 controls the switching portion 35 so that the conveyance destination of the subsequent sheet P is switched to, of the plurality of branch conveyance passages XB, the one with the longest conveyance distance for the sheet P (e.g., the first branch conveyance passage XB1) (S7).

Specifically, what takes place after a sheet P is conveyed via the second branch conveyance passage XB2 is as follows. After that sheet P (first sheet) is conveyed via the second branch conveyance passage XB2, based on the sensing timing of the subsequent sheet P (second sheet) by the assist sensor 32 of, the controller 110 determines what to do with the second sheet. If conveying the second sheet via the first branch conveyance passage XB1 permits it to be conveyed in time for its being placed at a particular position on the first conveyance belt 8 after the first sheet, the controller 110 controls the switching portion 35 so that the second sheet is conveyed via the first branch conveyance passage XB1. If conveying the second sheet via the first branch conveyance passage XB1 does not permit in-time placement but conveying it via the second branch conveyance passage XB2 does, the controller 110 has the second sheet conveyed via the second branch conveyance passage XB2. If even conveying the second sheet via the second branch conveyance passage XB2 does not permit in-time placement, the controller 110 controls the switching portion 35 so that the second sheet is conveyed via the first branch conveyance passage XB1 and is placed at a particular position further after the particular position after the first sheet. If the second sheet is conveyed via the second branch conveyance passage XB2, the further subsequent sheet P is handled similarly.

Likewise, on completion of one print job, if a conveyance delay occurs in the sheet P in the following print job, the switching portion 35 can, by switching the conveyance destination of that sheet P from the branch conveyance passage XB with the longest conveyance distance (e.g., the first branch conveyance passage XB1) to a branch conveyance passage XB with a shorter conveyance distance (e.g., the second branch conveyance passage XB2), reduce the conveyance time of the sheet P up to the first conveyance belt 8. It is thus possible to easily cope with an conveyance delay of the sheet P in the following job.

As described above, with the configuration according to the embodiment, even if the recording medium has a conveyance delay, it is possible to place the recording medium on the conveyance belt at a particular position relative to the openings in it (e.g., at a position displaced in the conveyance direction from the openings) and make the recording heads perform flushing involving ink ejection through the openings.

7. Modifications: Preferably, the respective lengths of the first and second branch conveyance passages XB1 and XB2 are set such that the maximum difference between the conveyance time taken to convey the sheet P across the distance LC+L1 and the conveyance time taken to convey the sheet P across the distance LC+L2 is equal to or more than the maximum passage time difference between the openings 80 in two adjacent groups of openings 82 along the conveyance direction of the first conveyance belt 8 during belt movement (i.e., the maximum interval between the openings 80 in those groups of openings 82 in the conveyance direction divided by the belt movement speed). With this configuration, even if a conveyance delay as long as the just mentioned maximum passage time difference occurs in the sheet P, it is possible to compensate for the conveyance delay by switching the conveyance destination from the first branch conveyance passage XB1 to the second branch conveyance passage XB2 and adjusting (increasing) the conveyance speed of the sheet P by the pair of assist rollers 33*a*.

The control by the controller 110 described in connection with the embodiment is applicable not only to cope with a conveyance delay of a sheet P but also to cope with intermittent printing. Here, intermittent printing denotes, for example, printing in which, during image formation on one of a plurality of sheets P, the image processing takes so much time that the conveyance of the subsequent sheets P has to be delayed, resulting in larger sheet-to-sheet intervals and hence poor productivity. In intermittent printing, the conveyance of sheets P is delayed as just mentioned; thus, as in the embodiment, the controller 110 can control the switching portion 35 and, as necessary, control the rotation speed of the pair of assist rollers 33*a* in the conveyance speed adjusting portion 33, and can thereby permit the sheet P to reach a particular position on the first conveyance belt 8 and make the recording heads 17*a* to 17*c* perform flushing through the particular openings 80.

While the embodiment deals with control for coping with a conveyance delay of a sheet P fed out of the sheet feed cassette 2 by the sheet feeding portion 3, the control for the switching portion 35 and the conveyance speed adjusting portion 33 (pair of assist rollers 33*a*) according to the embodiment is applicable also to cope with a conveyance delay that occurs with a sheet P placed on the hand-feed tray 2*a*. Also in the reversing conveyance passage 16, if there is a risk of a sheet P slipping and suffering a conveyance delay, a plurality of branch paths can be provided and control similar to that in the embodiment (branch path switching and conveyance speed adjustment) can be performed to compensate for the conveyance delay of the sheet P.

While the embodiment deals with a construction where a sheet P is conveyed in a state held on the first conveyance belt 8 under negative-pressure suction, instead the first conveyance belt 8 may be electrostatically charged so that the sheet P is conveyed in a state held on the first conveyance belt 8 under electrostatic suction (i.e., electrostatic suction method).

While the embodiment deals with an example where, as an inkjet recording apparatus, a color printer that records a color image with ink of four colors is used, the control according to the embodiment is applicable also in cases where a monochrome printer that records a monochrome image with black ink is used.

While an embodiment of the present disclosure has been described, it is not meant to limit the scope of the present disclosure, which thus allows for various modifications without departure from the spirit of the present disclosure.

The present disclosure is applicable to inkjet recording apparatuses such as inkjet printers.

What is claimed is:

1. An inkjet recording apparatus comprising:

a recording head having a plurality of nozzles through which ink is ejected;

a conveyance belt for conveying a recording medium, the conveyance belt being endless and having along a conveyance direction of the recording medium a plurality of openings through which the ink is passed when the recording head performs flushing in which the ink is ejected from the nozzles with timing different from timing for image formation;

a sheet feeding portion for feeding out the recording medium;

a shared conveyance passage for conveying the recording medium fed out from the sheet feeding portion;

a plurality of branch conveyance passages branching off the shared conveyance passage and meeting the shared conveyance passage upstream of the conveyance belt, for feeding the recording medium conveyed along the shared conveyance passage to the conveyance belt;

a switching portion for switching a conveyance destination of the recording medium conveyed along the shared conveyance passage to one of the plurality of branch conveyance passages;

a recording medium sensor for sensing the recording medium fed out from the sheet feeding portion; and a controller for controlling the switching portion, wherein the plurality of branch conveyance passages include branch conveyance passages with different conveyance distances for the recording medium, and the controller controls the switching portion such that the switching portion switches the conveyance destination of the recording medium to one of the plurality of branch conveyance passages based on sensing timing of the recording medium by the recording medium sensor.

2. The inkjet recording apparatus according to claim 1, wherein the controller changes the conveyance destination of the recording medium between different ones of the branch conveyance passages depending on whether or not, based on the sensing timing, the controller recognizes a conveyance delay of the recording medium that amounts to a predetermined time.

3. The inkjet recording apparatus according to claim 1, wherein the controller changes the conveyance destination of the recording medium between different ones of the branch conveyance passages depending on whether the sensing timing is earlier or later than predetermined timing that is later by a predetermined time than a start time point of feeding-out of the recording medium by the sheet feeding portion.

4. The inkjet recording apparatus according to claim 1, further comprising:

a conveyance speed adjusting portion for conveying the recording medium fed out from the sheet feeding portion and adjusting a conveyance speed of the recording medium, wherein the controller controls the conveyance speed adjusting portion such that the conveyance speed of the recording medium when the sensing timing is earlier than predetermined timing that is later by a predetermined time than a start time point of feeding-out of the recording medium by the sheet feeding portion is higher than the conveyance speed of the recording medium when the sensing timing is later than the predetermined timing.

5. The inkjet recording apparatus according to claim 4, wherein the plurality of branch conveyance passages comprises:

a first branch conveyance passage; and a second branch conveyance passage with a shorter conveyance distance for the recording medium than the first branch conveyance passage, and when a conveyance distance of the recording medium from the recording medium sensor to a branch point of the plurality of branch conveyance passages is LC (mm), a conveyance distance of the recording medium in the first branch conveyance passage is L1 (mm), a predefined conveyance speed of the recording medium is Sdef (mm/sec), an upper limit value of the conveyance speed up to which the conveyance speed adjusting portion can adjust the conveyance speed is Smax (mm/sec), an elapsed time from the start time point of the feeding-out of the recording medium by the sheet feeding portion to the sensing timing is Tmeasure (sec), a predefined initially set time from the start time point of the feeding-out of the recording medium by the sheet feeding portion to the sensing timing is Tdef (sec), and a conveyance delay time of the recording medium is Tslip (sec), then $$Tslip=Tmeasure-Tdef, \text{ and}$$

the controller controls the switching portion such that the recording medium passes through the first branch conveyance passage if $$Tslip \leq (LC+L1)/Sdef-(LC+L1)/Smax \qquad \text{Condition (1):}$$

is satisfied.

6. The inkjet recording apparatus according to claim 5, wherein the controller controls the conveyance speed adjusting portion such that the recording medium is conveyed at a conveyance speed Scontrol (mm/sec) that satisfies $$(LC+L1)/Sdef-Tslip=(LC+L1)/Scontrol.$$

7. The inkjet recording apparatus according to claim 5, wherein when the conveyance distance of the recording medium in the second branch conveyance passage is L2 (mm), then the controller controls the switching portion such that the recording medium passes through the second branch conveyance passage if $$Tslip>(LC+L1)/Sdef-(LC+L1)/Smax \text{ and} \qquad \text{Condition (2):}$$

$$Tslip \leq (LC+L1)/Sdef-(LC+L2)/Smax \qquad \text{Condition (3):}$$

are satisfied.

8. The inkjet recording apparatus according to claim 7, wherein the controller controls the conveyance speed adjusting portion such that the recording medium is conveyed at a conveyance speed Scontrol (mm/sec) that satisfies $$(LC+L1)/Sdef-Tslip=(LC+L2)/Scontrol.$$

9. The inkjet recording apparatus according to claim 4, wherein the conveyance speed adjusting portion comprises at least one pair of conveyance rollers for conveying the recording medium.

10. The inkjet recording apparatus according to claim 1, further comprising:

an opening sensor for sensing the openings, which move as the conveyance belt moves, wherein the controller starts feeding-out of the recording medium by the sheet feeding portion with timing earlier, by a predefined conveyance time of the recording medium from the sheet feeding portion via the shared conveyance passage and a longest one of the branch conveyance passages to the conveyance belt, than a time point at which the recording medium reaches a particular position on the conveyance belt displaced in the conveyance direction from a particular opening among the plurality of openings sensed by the opening sensor.

11. The inkjet recording apparatus according to claim 1, wherein the plurality of branch conveyance passages comprises:

a first branch conveyance passage; and a second branch conveyance passage with a shorter conveyance distance for the recording medium than the first branch conveyance passage, and the controller controls the switching portion such that, after completion of a print job in which at least one sheet of the recording medium conveyed via the second branch conveyance passage is subjected to the image formation by ink ejection, the switching portion switches the conveyance destination of a subsequent sheet of the recording medium to the first branch conveyance passage.

* * * * *